US009278789B2

(12) United States Patent
Simpson

(10) Patent No.: US 9,278,789 B2
(45) Date of Patent: Mar. 8, 2016

(54) LOCKABLE CAP FOR MEDICAL PRESCRIPTION BOTTLE

(71) Applicant: Joseph C. Simpson, Lincoln, CA (US)

(72) Inventor: Joseph C. Simpson, Lincoln, CA (US)

(73) Assignee: GATEKEEPER INNOVATIONS, INC., Sacramento, CA (US)

( * ) Notice: Subject to any disclaimer, the term of this patent is extended or adjusted under 35 U.S.C. 154(b) by 0 days.

(21) Appl. No.: 14/194,335

(22) Filed: Feb. 28, 2014

(65) Prior Publication Data

US 2014/0175041 A1 Jun. 26, 2014

Related U.S. Application Data

(63) Continuation of application No. 12/573,799, filed on Oct. 5, 2009, now Pat. No. 8,662,330.

(60) Provisional application No. 61/239,597, filed on Sep. 3, 2009.

(51) Int. Cl.

| | |
|---|---|
| ***B65D 50/00*** | (2006.01) |
| ***B65D 50/06*** | (2006.01) |
| ***B65D 55/14*** | (2006.01) |
| ***B65B 69/00*** | (2006.01) |

(52) U.S. Cl.

CPC ..... *B65D 50/06* (2013.01); *B65B 69/00* (2013.01); *B65D 55/145* (2013.01); *Y10T 29/49826* (2015.01); *Y10T 70/554* (2015.04)

(58) Field of Classification Search

CPC .. B65D 55/145; B65D 55/14; E05B 37/0048; E05B 37/0051; E05B 37/0055; E05B 37/0058

USPC ..... 215/207, 201, 206, 219; 70/167, 168, 70/63, 165, 163, 312, 158

See application file for complete search history.

(56) References Cited

U.S. PATENT DOCUMENTS

| | | | |
|---|---|---|---|
| 2,009,216 | A | 7/1935 | Anibal |
| 3,151,756 | A | 10/1964 | Paul |
| 3,426,932 | A | 2/1969 | Rouse |
| 3,445,021 | A | 5/1969 | Johnson |
| 3,684,117 | A | 8/1972 | Leopoldi et al. |
| 3,843,007 | A | 10/1974 | Meyer |
| 3,901,407 | A | 8/1975 | Mitchell et al. |
| 3,998,078 | A | 12/1976 | Detwiler |
| 4,366,687 | A | 1/1983 | Atkinson |
| 4,383,425 | A | 5/1983 | Orabona |
| 4,520,641 | A | 6/1985 | Bako |
| 4,794,768 | A | 1/1989 | Moser et al. |
| 4,829,796 | A | 5/1989 | Kim |

(Continued)

FOREIGN PATENT DOCUMENTS

| | | | |
|---|---|---|---|
| CN | 2897860 | Y | 5/2007 |

OTHER PUBLICATIONS

PCT International Search Report of PCT/US10/47589; dated Oct. 22, 2010 (2 pgs.).

(Continued)

*Primary Examiner* — Jeffrey Allen
(74) *Attorney, Agent, or Firm* — DLA Piper LLP (US)

(57) ABSTRACT

A lockable cap, is a security feature for a medical prescription bottle. There is a three dial locking mechanism that is attached to the cap and the dial locking mechanism and the cap can be attached or removed from the bottle only when the user has the correct combination on the dial lock.

5 Claims, 12 Drawing Sheets

(56) References Cited

U.S. PATENT DOCUMENTS

| | | | |
|---|---|---|---|
| 4,907,430 | A | 3/1990 | Hong |
| 4,984,698 | A | 1/1991 | Stuckey |
| 5,277,325 | A | 1/1994 | Yan |
| 5,911,764 | A | 6/1999 | Wei Kong |
| 1,358,352 | A | 11/2000 | Wheelock |
| 6,688,146 | B2 | 2/2004 | Michels et al. |
| 6,786,346 | B1 | 9/2004 | Gurnard et al. |
| 6,793,081 | B1 | 9/2004 | Derman |
| 6,912,878 | B2 | 7/2005 | Belden, Jr. |
| 6,988,642 | B2 | 1/2006 | Galto, Jr. et al. |
| 7,350,655 | B2 | 4/2008 | Belden, Jr. |
| 2003/0089145 | A1 | 5/2003 | Michels et al. |
| 2004/0011098 | A1 | 1/2004 | Yang |
| 2006/0207958 | A1 | 9/2006 | Hamer |
| 2008/0098939 | A1 | 5/2008 | Kalous et al. |
| 2008/0302794 | A1 | 12/2008 | Wagner et al. |

OTHER PUBLICATIONS

PCT Written Opinion of PCT/US10/47589; dated Oct. 22, 2010 (6 pgs.).

PCT International Preliminary Report of PCT/US10/47589; dated Mar. 6, 2012 (7 pgs.).

Extended European Search Report of EP 10814459.3; dated Dec. 20, 2012 (4 pgs.).

First Office Action for CN 201080049649.2 (English and Chinese; dated Dec. 25, 2013 (15 pgs.).

LOCKABLE CAP FOR MEDICAL PRESCRIPTION BOTTLE

RELATED PATENT APPLICATIONS/PRIORITY CLAIMS

This patent application is a continuation of and claims priority under 35 USC 120 to U.S. patent application Ser. No. 12/573,799 filed on Oct. 5, 2009 and entitled "Lockable Cap for Medical Prescription Bottle" which in turn claims the benefit under 35 USC 119(e) to U.S. Provisional Application Ser. No. 61/239,597, filed on Sep. 3, 2009, which is incorporated herein fully by reference.

BACKGROUND OF THE INVENTION

Field of the Invention

This invention is a security device to reduce unauthorized teenage, or other unauthorized user, prescription drug abuse. There is a problem with unauthorized users taking potentially harmful and addictive prescription medications from unmonitored medicine cabinets. People are unaware about how vulnerable their prescriptions can be when the only security device protecting them is a child proof cap. This invention adds a security measure to a bottle. With a more secure bottle fewer unauthorized users will have access to potentially dangerous and addictive medications. This device prevents an unauthorized user from taking a few pills that could go unnoticed by the prescription drug holder. For example, the security device can be broken in order to gain access, but this action would be noticeable by the prescription drug holder, and therefore further security actions can be taken.

BRIEF SUMMARY OF THE INVENTION

This invention provides a security feature that can be attached to a bottle. There is a dial locking mechanism that has been attached to a cap. The unit can be attached or removed only when the user has the correct combination on the dial lock. When the combination is incorrect a mechanism within the cap is disengaged and the inner cap cannot be removed from the bottle.

DETAILED DESCRIPTION OF THE INVENTION

Figure 1:
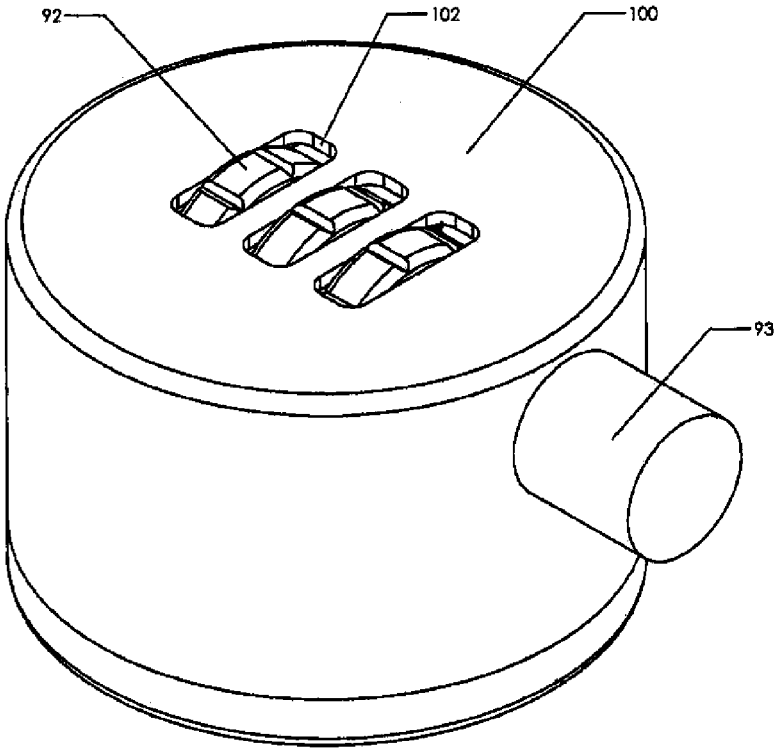
FIG. 1 is a perspective view of the assembled cap locking device.
Figure 2:
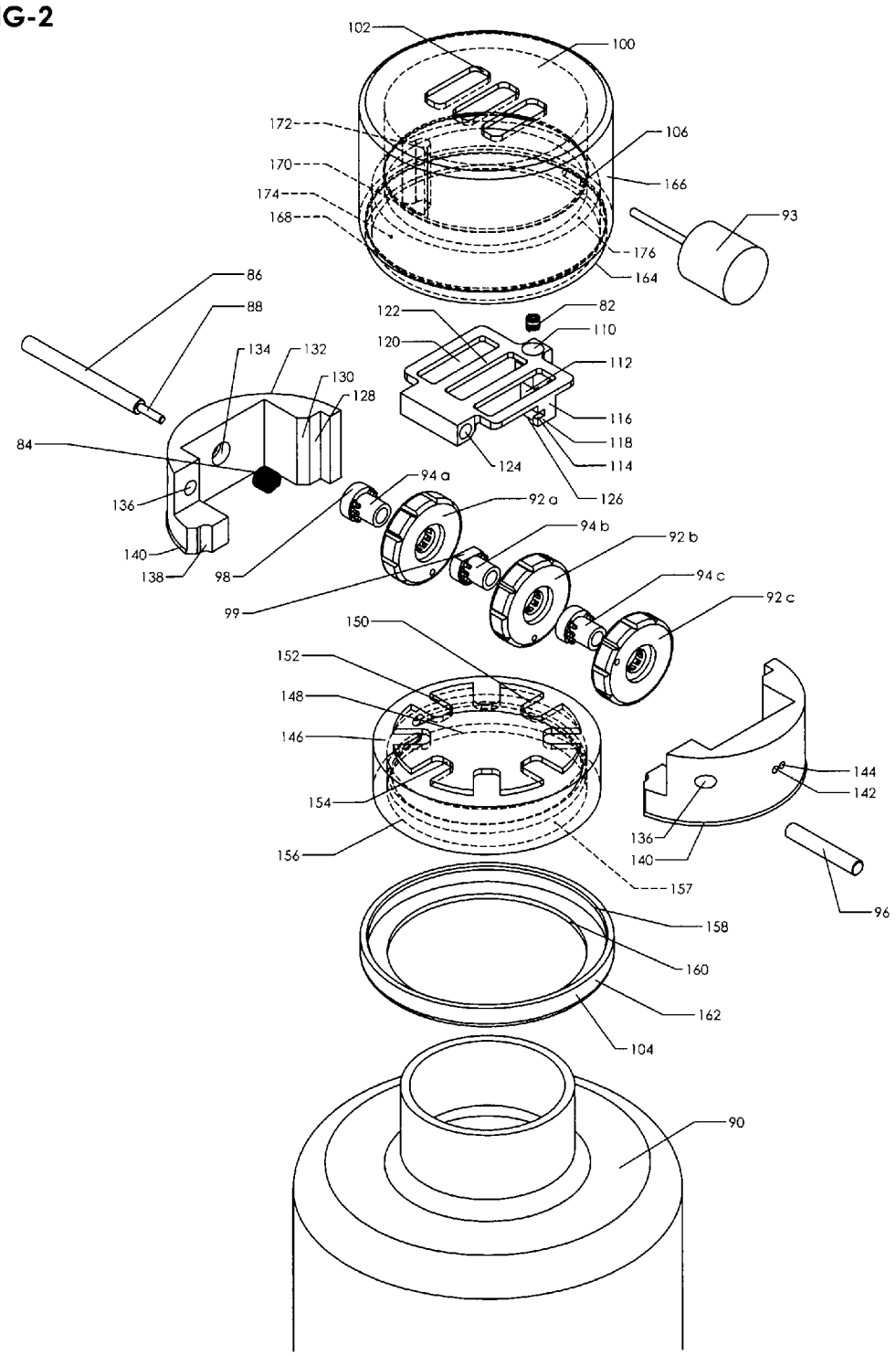
FIG. 2 is an exploded view of the internal parts of the locking device.

This device puts a combination dial lock of FIG. 1 onto a bottle 90 of FIG. 2. The lower portion of the design contains the dog plate shown in FIG. 4A. The inner portion of the dog plate is threaded as at 157 shown in FIG. 5B in order to twist onto a common prescription bottle 90. The dog plate of FIG. 5A. has a flat circular set of gear teeth of which 148 in an example. Each large and durable tooth surface 154 allows for a single point of contact to exert enough tension to apply and remove the cap. These teeth are set away from the side wall with a gap 146 that gap allows the dog plate to spin freely within housing 100 at 176 of FIG. 3 and of FIG. 7B. Above the dog plate is the dial lock shown in FIG. 1. The dial lock is of a well known type. As seen in FIG. 2, this set of dial lock wheels contains both numeric cogs 92 and the standard cams 94*a*, 94*b*, and 94*c*. The cams are spring held into the numeric cogs. The shape of the cams illustrates what movements are possible, all of the cams have one flat secant section removed 99. These flat sections on the cams work in unison with each other, only when all the flat sections of the cams line up will the unit become unlocked. These wheels both spin on the dowel pin axle 86, and are held in place with a spring 84 on the far left of dowel pin axle. Above the dials is the lock plate 122 of FIG. 3A which lies above the cams 94*a*, 94*b*, and 94*c* of FIG. 2. This moving part shown at 122 connects and disconnects from the dog plate 156 of FIG. 2 and of FIG. 5A. This is also the component that allows the system to be reset. Only when the locking plate is down (unlocked) 114 can the user reset the dials to their personal combination. The bottle locking device is controlled by a horizontal tamper resistant outlet. The combination is reset using a specific lengthened pin 93 that is designed to offset the numeric cogs 92 from the large cams 94*a*, 94*b*, and 94*c*. Surrounding the large locking plate and the dials are the alignment spacers seen in FIG. 5A and FIG. 4B. The left alignment spacer seen in FIG. 4A and the right alignment spacer seen in FIG. 4B act to stabilize the dowel pin axle 86 as seen in FIG. 2 and holds the inner components of the bottle locking device in place. The right alignment spacer has an additive access outlet 144. Surrounding all of the components is the housing 100.

This bottle locking device is based on an idea of a gear slipping device. When the cap is unlocked the locking plate 122 in FIG. 2 and FIG. 3A that sits on the cams 94*a-c* is rotated into the flat position. With this cam position shown at 99 of FIG. 2, the lock plate is in the down position making the connection between the lock plate of FIG. 3B at 126 and the dog plate FIG. 5A at 150 for applying the cap and 152 for removing the cap.

Figure 3A:
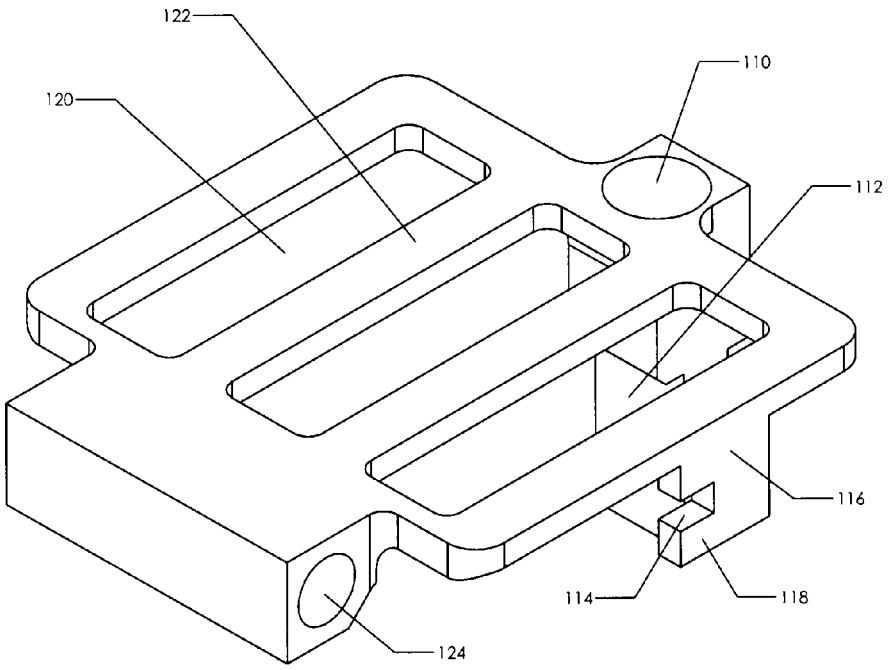
FIG. 3A is an isometric view of the lock plate.
Figure 5A:
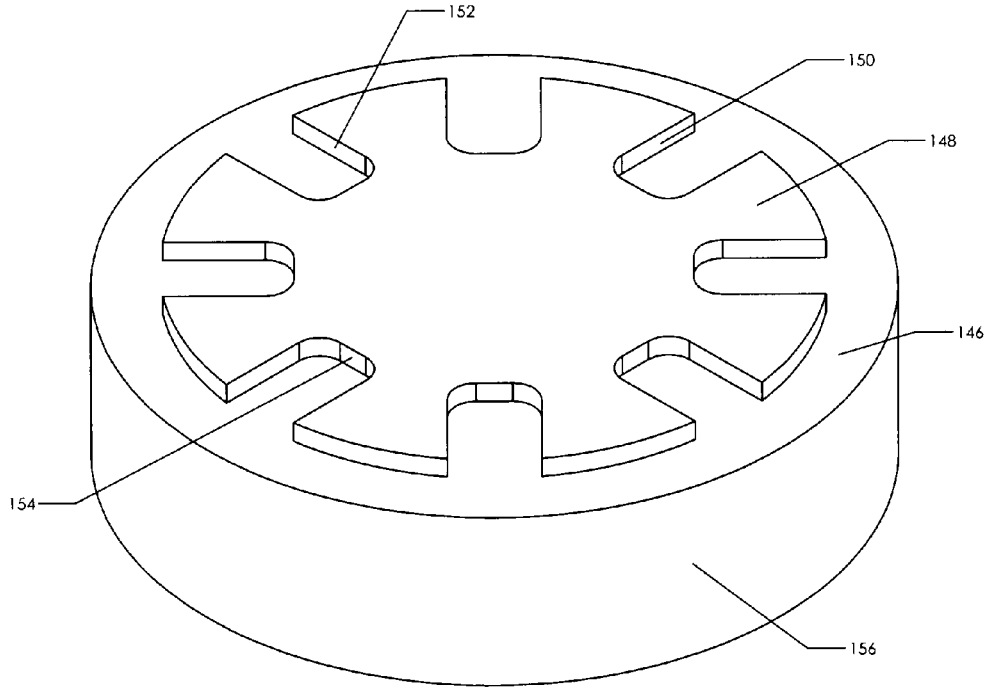
FIG. 5A is an illustration of the dog plate which connects to prescription bottle.

This bottle locking device is small and compact The locking plate 122 of FIG. 3 and FIG. 3A and dog plate 156 of FIG. 5A can only come together with the correct combination in the numeric cogs 92*a*, 92*b*, and 92*c*. With this connection the dog plate FIG. 5A cannot slip and the cap can be removed. When the cap is locked, the locking plate 122 of FIG. 3A is held upward by the dial lock, with at least one cam 94*a-c* rotated into the up position 98 of FIG. 2. With at least one cam in upward position 98 the gear connection cannot engage and therefore the dog plate 156 of FIG. 5A will slip. When the gears slip no torque can be applied to the inner cap, therefore it cannot be removed from the bottle 90.

The locking plate 122 of FIG. 3A allows the dial locking mechanism of FIG. 1 moves the locking plate 122 of FIG. 2 and of FIG. 3A in an upward motion and downward motion. Unlike a conventional dial locking system this design has a locking plate above the dials; other designs have this component below the dials. This is significant because it allows users to put downward pressure on the locking cap at 100 and on the dials without the notches compromising the correct combination of the cams 94*a-c*. The positioning of the locking plate of FIG. 3A allows the unit to be a top positioned lock plate.

This allows downward pressures to be applied without the locking components being mechanically influenced to any substantial degree. This position has the advantage of eliminating the possibility of someone being able to push downward in order to "feel" the combination. Therefore the position of the locking plate acts as a tamper resisting element. The locking plate has an extension 126 below the dials as seen in FIG. 2 and FIG. 3A which engage or disengage with the dog plate of FIG. 5A. On the right side of the locking plate is the reset access outlet 114. This outlet can be accessed only when the correct combination is entered (lock plate in the down position).

Figure 4A:
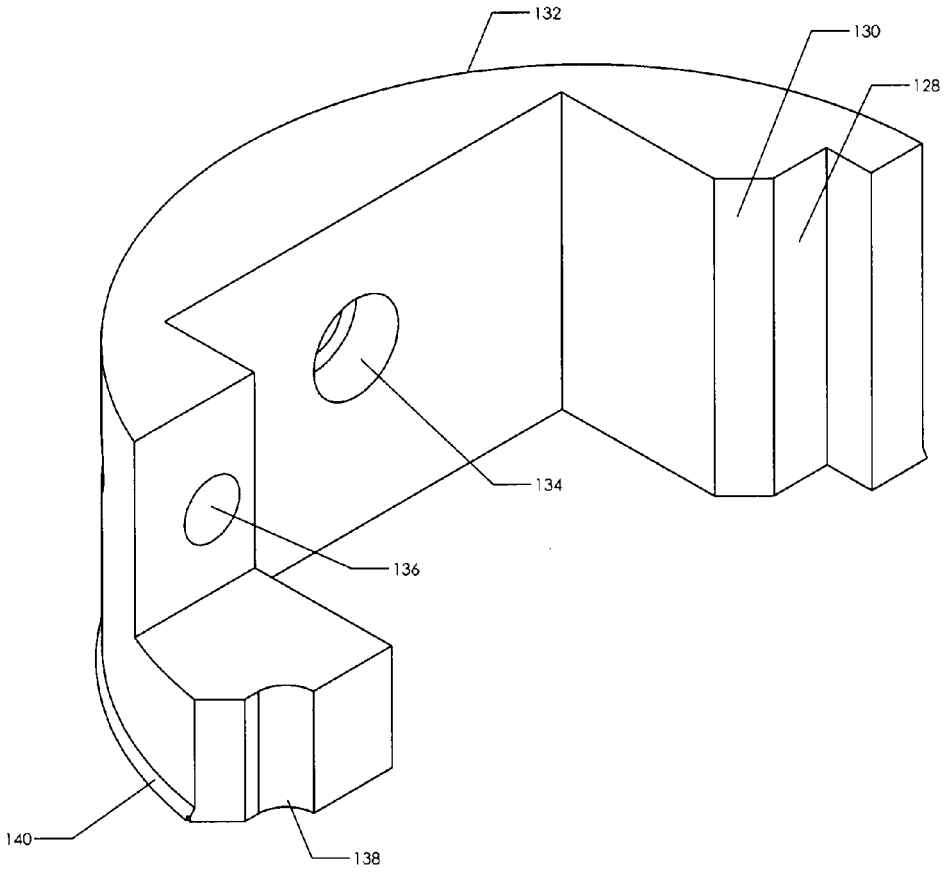
FIG. 4A is a view of the left alignment spacer.
Figure 4B:
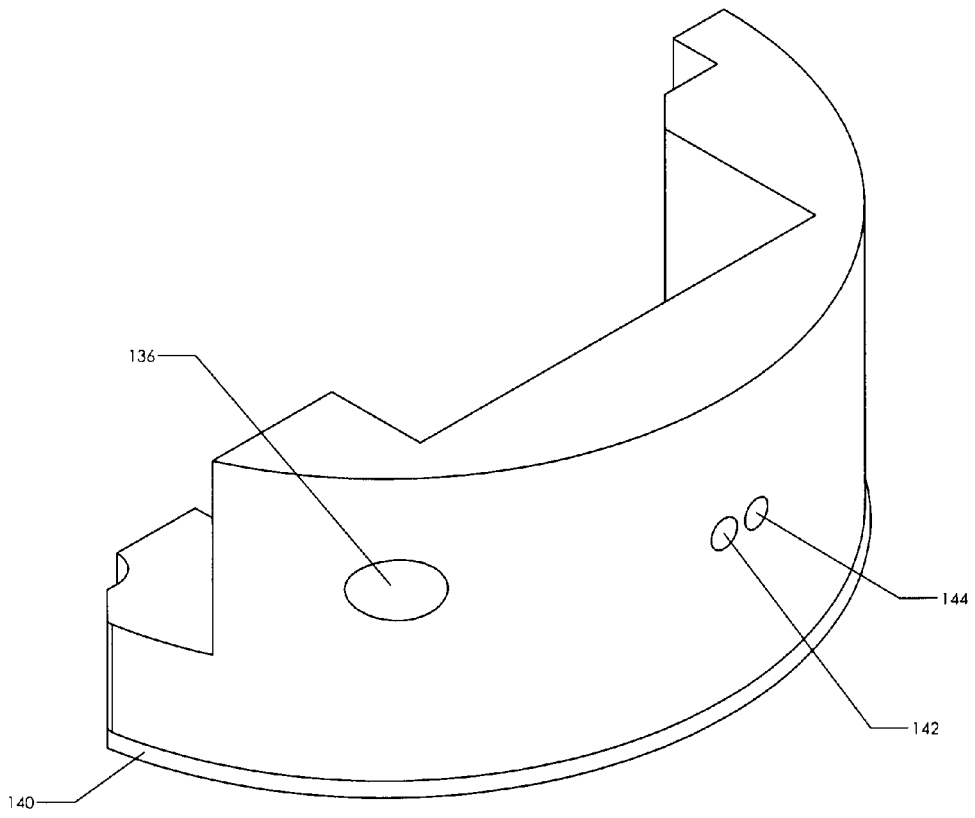
FIG. 4B is a view of the right alignment spacer.
Figure 5B:
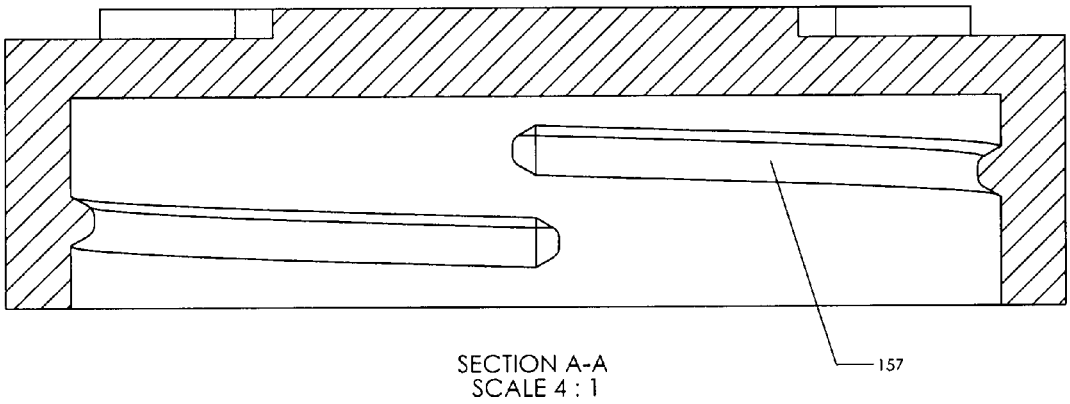
FIG. 5B is a side view of the dog plate that shows the inner features where the unit connects to the bottle.

Surrounding the locking plate of FIG. 3A are the alignment spacers of FIG. 4A and FIG. 4B. These right and left alignment spacers hold the locking plate of FIG. 3A in place and act as a mount 134 and 142 for the dowel pin axle 86 in FIG. 2. The lower portion of the alignment spacers 140 is slightly larger, this allows the alignment spacers to snap into the housing of FIG. 7B at 170. Both of the alignment spacers have a half channel 138, these are used both as a guide to line up the numeric cogs with the housing cut outs 102 and to prevent the inner components from rotating after assembly. These channels slide into the notch at 172 of FIG. 7C, when fully inserted the larger rim at the base of the alignment spacers 140 snap into 170 of the housing. With the combination of snap in feature 170 and the anti rotational channel 172 the alignment spacers are permanently held into the housing. The right alignment spacer of FIG. 4B has a reset access outlet 144 which is used for the unique horizontal space-saving pin-outlet resetting system.

Figure 3B:
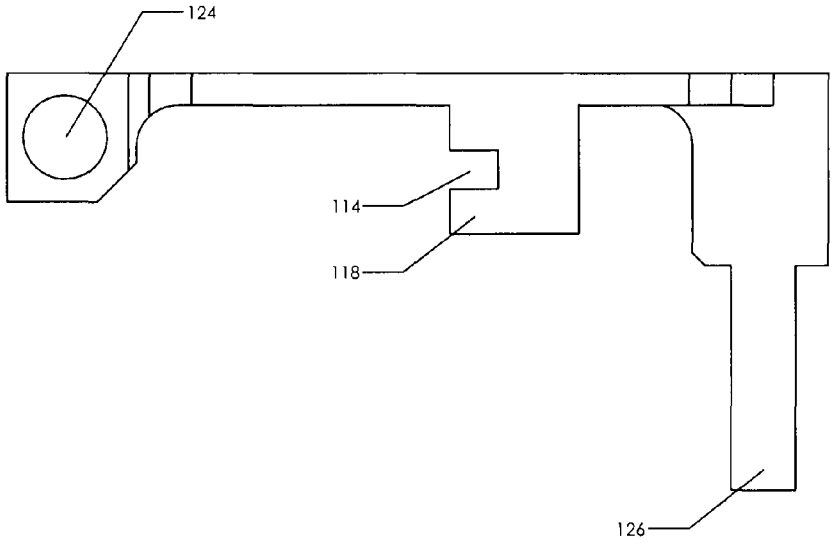
FIG. 3B is a side view of the isometric view shown in FIG. 3A.

This horizontal resetting system uses a fixed dowel pin 86 of FIG. 2 and relies on a horizontal resetting system based on the blocking ability 118 of the locking plate of FIG. 3A. The resetting system allows the user to reset the device to their personal combination. The system can only be reset when the device is unlocked (lock plate down). The locking plate is on a pivot 124 this pivot is connected with a pin 96. This pin sticks out on each side of the lock plate and is held in place by the alignment spaces at 136 of FIG. 2. The motion of the lock plate is controlled by the cams, only when all the cams are aligned like 94*b* is the system unlocked. When the system is unlocked the lock plate is moved down by a spring 82 that presses against a portion 110 of the locking plate, only in this down position can the system be reset. The outlet 114 of FIG. 3B is only accessible by the resetting pin 93 when the lock plate is down. The system is locked when even one cam is not in the flattened position, shown at 98. When locked the resetting pin 93 is blocked by the lock plate at 118 of FIG. 3B.

Figure 7A:
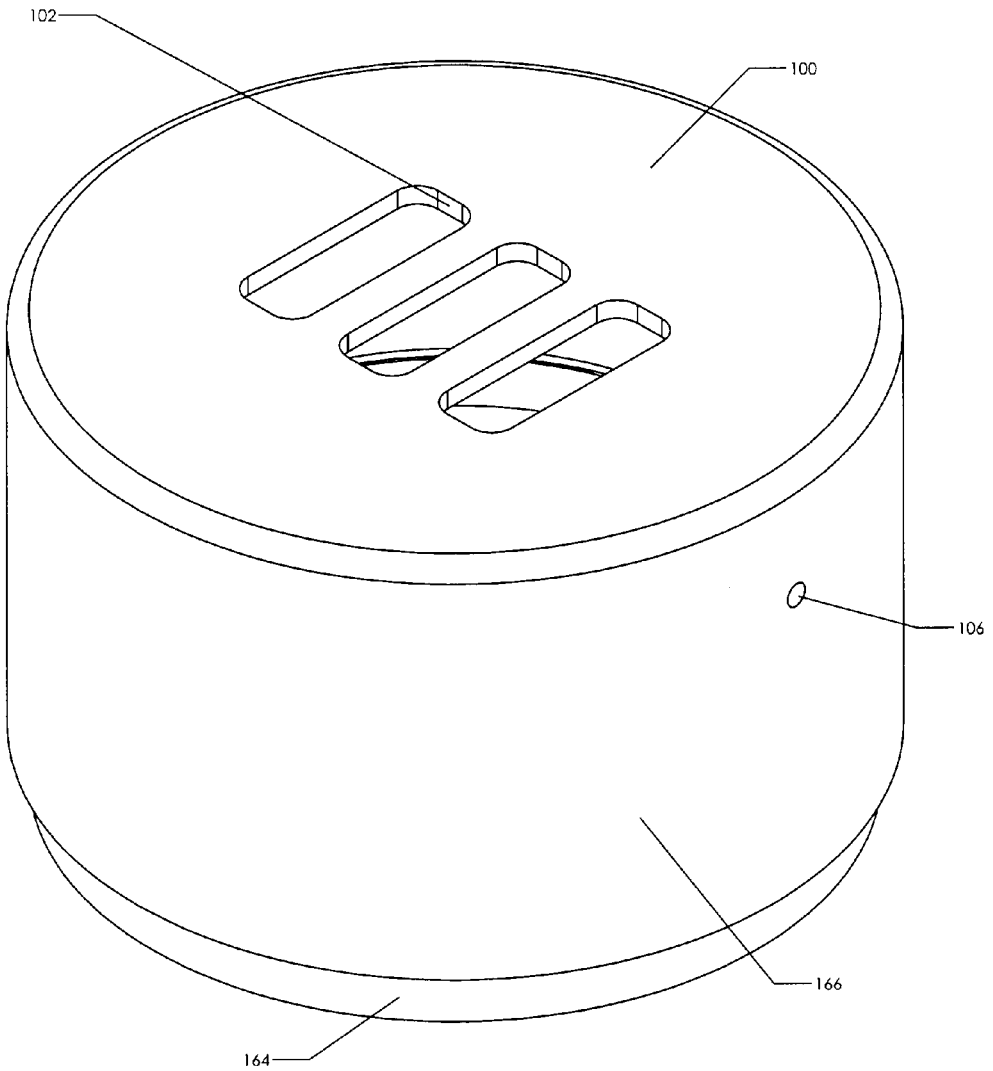
FIG. 7A is a view of the housing
Figure 7B:
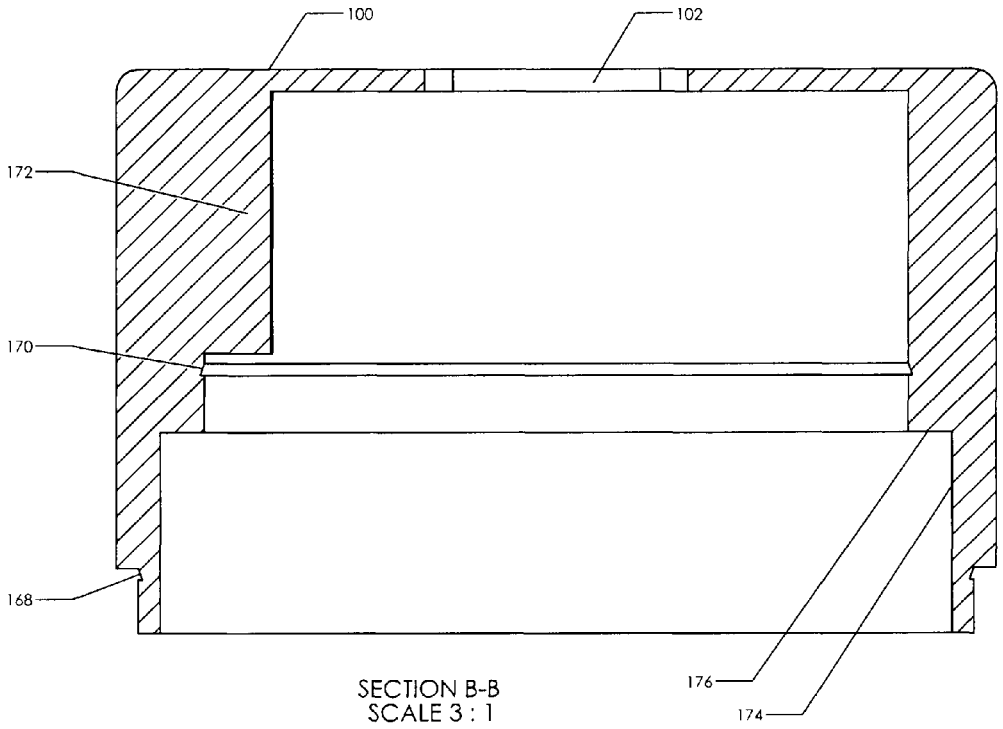
FIG. 7B is a side view of the housing that shows its internal features.
Figure 7C:
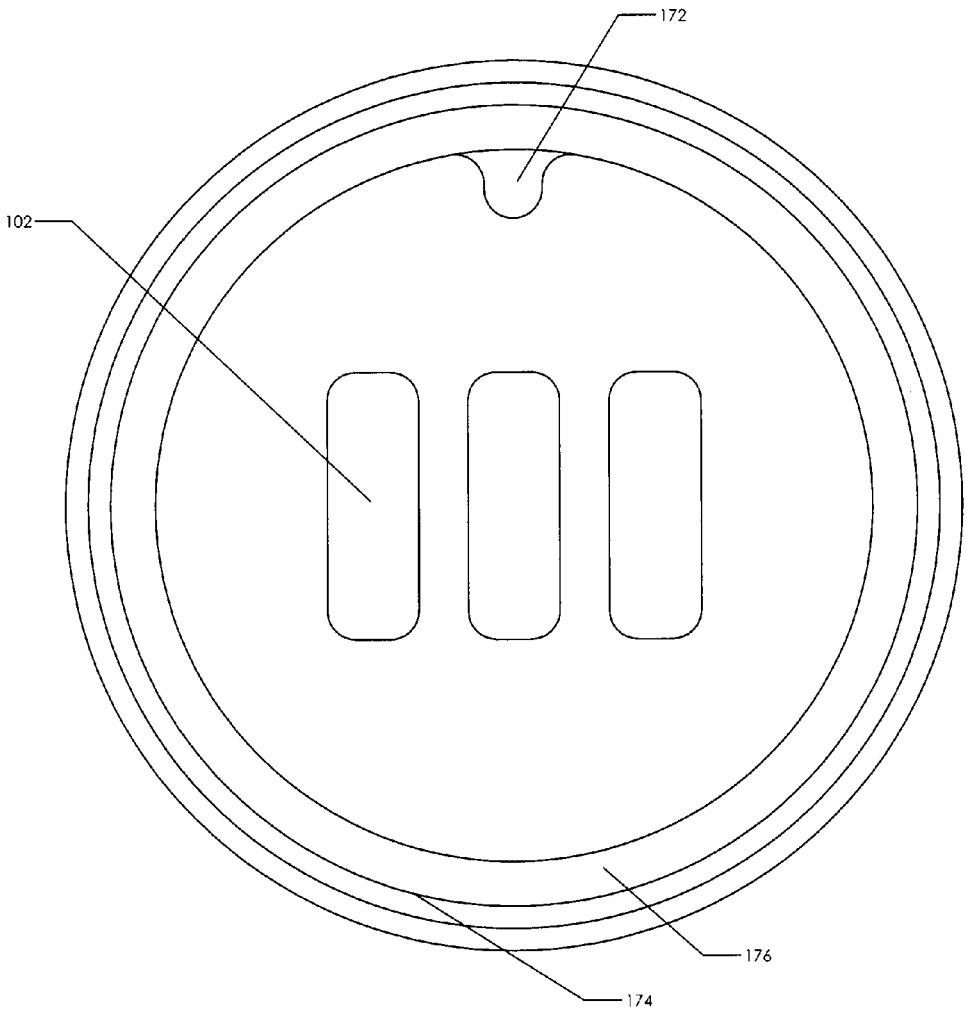
FIG. 7C is a bottom view of the housing.

To reset the combination the user pushes the pin 93 into the resetting outlet 106 located on the side of the housing FIG. 7A. Beyond the housing outlet at 106 the pin 93 passes through the reset outlet in the right alignment spacer at 144. From here the pin 93 passes through the outlet 114 of the lock plate FIG. 3B. The lock plate must be in the down position (unlocked) for the pin 93 to pass through the outlet 114 of the lock plate. When the system is locked the resetting outlet 114 is offset and the extension of 118 of FIG. 3B on the lock plate is blocking the resetting ability. The resetting-pin method relies on the upward bounded motion created by the locking plate of FIG. 3A to open and close the resetting outlet. When the system is locked the resetting outlet is blocked by element 118. When unlocked the pin passes through the outlet 114 and pushes onto the cam 94*c*, this force from the pin 93 contracts the spring 84 moving all of the cams 94*a*, 94*b*, and 94*c* to the left. This motion offsets the cams 94 *a-c*, from the numeric cogs 92. The numeric cogs are held in place by both the gaps of 102 in the upper portion of the housing and by the gaps shown at 120 in the lock plate. This separation between the cams and the numeric cogs allows the numeric cogs to spin independently, allowing the user to change the arrangement of the numeric cogs 92. When the pin 93 is removed the cams 94 *a-c* slides back into place with the numeric cogs 92, becoming coupled and once again spinning together. Below the alignment spacers there is the dog plate of FIG. 5A. This is the bottom set of slots 154 that sit in a circular pattern. These slots are offset from the edge 156 with a gap of 146. This gap comes into contact with the housing at 176 of FIG. 7B. This is not a solid connection instead these elements are made to slip freely without putting any tension put onto the threads. This ability to slip freely makes removing the locked cap nearly impossible. This inner laying set of slots 148 is the piece that the locking plate of FIG. 3A comes into contact to unlock the system. The inner portion of the dog plate 157 shown in FIG. 5B connects to a bottle 90.

Figure 6:
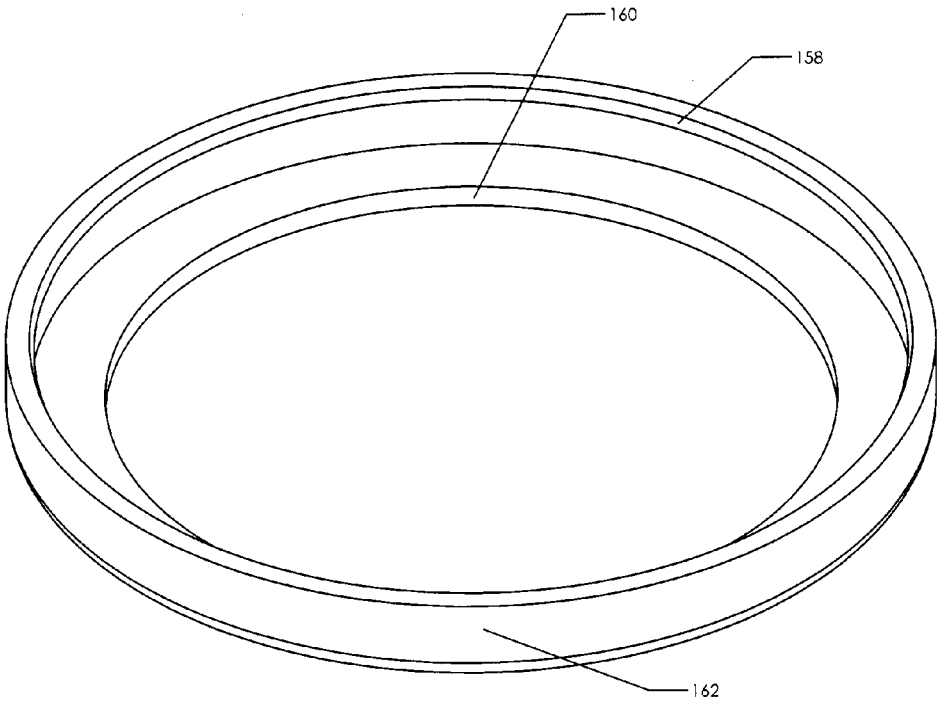
FIG. 6 is an illustration of the housing base plate.

The components discussed above are contained within the housing FIG. 7A. After the parts are inserted into the housing the housing, base plate 160 of FIG. 6 permanently attaches to the housing. The housing has inner cut ledges at 168 when assembled the opposite ledges of the housing base plate 158 come together for this permanent fit. This tight connection is possible because of the small elastic properties of the plastic. This outermost portion of the device has some tamperproof elements. The lower portion of the housing base plate 162 of FIG. 6 will become defective if someone tries to pry or forcefully pull out the dog plate FIG. 5A This defect will be noticeable by the owner because of damages caused to the outer portion of the device by prying or applying excessive forces to the lower housing. This will raise awareness for the owner and should result in further protection against unauthorized users. This bottle locking device is a deterrent against potential prescription drug abusers. This device has been created in order to keep prescription drugs in the hands of their owners.

This bottle locking device has been designed as a prevention device allowing prescription holders not only to have a more secure medical container, but also to be raise awareness when someone is tampering with their prescriptions. This is not a high security device; someone could still break or steal the bottle. This device is aimed at deterrence, removing the opportunity for teens to steal medications without the prescription holder's knowledge.

In addition to use for medical prescription bottles, there are many other uses such as a cap and lock for expensive perfumes, vitamins, supplements, and hazardous materials, among other uses. While the invention has been disclosed as set forth above, it will be appreciated by those of ordinary skill in the art that variations of the above disclosure can be made without departing from the spirit or the scope of the invention. For example, the two spacers described above can be made as a unitary spacer. To make a unitary spacer the numbered wheels and the cogs could be inserted from below. In addition, the housing and the spacers might possibly be combined into one piece. If it was one piece the dial locking mechanism would have to be inserted from below. The housing could possibly be two pieces. If the half the housing was combined with a spacer on each, one may be able to create a design that came together like a sandwich. Further, the locking plate could be designed differently, such as having two or more points of contact with the dog plate. In this regard, the locking plate should be able to block the ability of the unit to be reset. Still further, one may redesign the shape of the teeth above the cap on the dog plate. Their purpose is to put tension on the cap, so there are many different ways to design this lower set of tension gears without departing from the invention. In addition, half channel 138 on the spacers could be shaped differently and still retain its purpose for holding the spacers (and the dial lock within), not allowing the spacer to spin. Also, the lock plate could have more than one portion that connects with the dog plate.

I claim:

1. A method for operating a cap lock attached to a bottle, the cap lock having a housing having a cap portion and a base portion, the cap portion having an upper surface with a plurality of first gaps therein, an alignment spacer device and mounting the alignment spacer device within the housing, a rotatable dial lock, mounted within the alignment spacer device, having numeric cogs and cams in mechanical relationship with each other to allow the numeric cogs to spin independently and be settable to a plurality of settings, a dog plate attachable to said bottle and having free rotation in the housing and having a set of gear teeth that allow at least one point of contact for a locking plate to exert sufficient tension to remove said cap and a locking plate pivotable mounted to said alignment spacer device wherein the locking plate has a plurality of second gaps aligned with said plurality of first gaps whereby said numeric cogs are held in place by said plurality of first gaps and said plurality of second gaps and the locking plate being movable between a locked position and an unlocked position, the method comprising:

moving the locking plate to the unlocked position when the numeric cogs are at a predetermined setting;

pivoting the locking plate, when the locking plate is in the unlocked position, to engage the dog plate to exert sufficient tension to remove the cap;

moving the locking plate to the locked position when the numeric cogs are not at the predetermined setting;

preventing, by an arm of the locking plate, a reset of the predetermined setting when the locking plate is in the locked position; and resetting the predetermining setting of the numeric cogs when the locking plate is in the unlocked position.

2. The method of claim 1, wherein pivoting the locking plate further comprises pressing an extension of the locking plate into engagement with the set of gear teeth to exert sufficient tension to remove the cap.

3. The method of claim 1, wherein moving the locking plate to the locked position further comprises disengaging, by at least one of the cams, an extension of the locking plate from the dog plate whereby said cap cannot be removed from said bottle.

4. The method of claim 3 further comprising allowing the set of teeth of the dog plate to rotate with respect to the locking plate when the locking plate is in the locked position.

5. The method of claim 4 further comprising rotating the set of gear teeth of the dog plate horizontally with respect to the upper surface of said cap portion.

* * * * *